US007654279B2

(12) United States Patent
Horton, III et al.

(10) Patent No.: US 7,654,279 B2
(45) Date of Patent: Feb. 2, 2010

(54) DEEP WATER GAS STORAGE SYSTEM

(75) Inventors: Edward E. Horton, III, Houston, TX (US); James V. Maher, Houston, TX (US)

(73) Assignee: AGR Deepwater Development Systems, Inc., Houston, TX (US)

( * ) Notice: Subject to any disclaimer, the term of this patent is extended or adjusted under 35 U.S.C. 154(b) by 184 days.

(21) Appl. No.: 11/506,288

(22) Filed: Aug. 19, 2006

(65) Prior Publication Data

US 2008/0041291 A1 Feb. 21, 2008

(51) Int. Cl.
*B65D 88/78* (2006.01)
*F17C 1/00* (2006.01)

(52) U.S. Cl. ..... 137/236.1; 405/210

(58) Field of Classification Search ..... 137/236.1; 405/210, 53, 59
See application file for complete search history.

(56) References Cited

U.S. PATENT DOCUMENTS 3,710,582 A * 1/1973 Hills et al. ..... 405/210
3,727,418 A * 4/1973 Glazier ..... 62/53.1
3,835,653 A * 9/1974 Hix, Jr. ..... 405/210
4,209,271 A * 6/1980 McCabe et al. ..... 405/210
4,446,804 A 5/1984 Kristiansen et al.
4,846,088 A 7/1989 Fanse et al.
5,201,611 A * 4/1993 Komaki et al. ..... 405/193
5,615,702 A 4/1997 Dawans et al.
6,598,408 B1 * 7/2003 Nierenberg ..... 62/53.2
6,655,155 B2 12/2003 Bishop
6,725,671 B2 4/2004 Bishop
6,817,809 B2 11/2004 Choi et al.
6,863,474 B2 3/2005 Webster et al.

* cited by examiner

*Primary Examiner*—Kevin L Lee
(74) *Attorney, Agent, or Firm*—Conley Rose, P.C.

(57) ABSTRACT

A deep ocean gas storage system for storing compressed gas, the system comprising an inflexible thin walled storage vessel anchored to the sea floor having an axis located in water substantially perpendicular to and on a sea floor below sea level, a gas intake for admitting and discharging compressed natural gas to and from the vessel; a water port for admitting and discharging water to the vessel using hydrostatic pressure to discharge compressed gas from the vessel at a substantially constant discharge pressure as the volume of the gas in the storage vessel decreases when water content of the vessel increases; a conduit fluidly connected with the water port oriented substantially parallel to the axis having a discharge opening above the level of sea water in the vessel; and a valve disposed at the gas intake to the vessel for controlling compressed gas admission and discharge.

18 Claims, 8 Drawing Sheets

DEEP WATER GAS STORAGE SYSTEM

FIELD

The present embodiments relate generally to a gas storage facility on the bottom of the ocean in deepwater.

BACKGROUND

Oil at standard temperature and pressure conditions is a liquid and is reasonably dense and suitable for transportation. The market for oil is global in nature because it can be readily transported in tankers and stored in surface storage containers. Because of natural gases gaseous nature, natural gas is far more difficult to transport and store. Most natural gas is transported through pipelines, which means that sources of supply must be local. Gas is usually stored in underground natural caverns and the storage locations are therefore tied to the availability of these caverns.

A need has exists to link a subsea storage facility near the subsea pipelines in an economical manner, that is easy to monitor and with few moving parts for failure.

The main complication in development of a global gas industry is that at standard temperature and pressure (stp), gas is extremely diffuse and therefore has very little economic value for a given volume compared to oil (a difference of three orders of magnitude at $7/MCF for gas and $50/BBL for oil). Due to this difference in value per volume, combined with the gaseous state, transport of gas over long distances at stp is not economically feasible. Various methods for achieving more favorable ratios of gas value for a given volume are commonly used to make the transmission and storage more economically attractive, such as compressing or liquefying it. Compression is the most commonly used method for transportation because it is the preferred method of use in pipeline systems. Both methods can be used for marine transportation wherein liquefaction is used for Liquified Natural Gas (LNG) and compression is used for Compressed Natural Gas (CNG).

A measure of the economic feasibility for storing and transporting gas is the volume ratio, defined as volume of gas that can be stored in a given volume in its compressed condition divided by the volume of gas that could be stored in the same volume at standard temperature and pressure. LNG has a volume ratio of roughly 600, which means that its economic value per cubic meter is roughly a factor of two less than that of oil at the price conditions listed above. Although CNG has not been used to date, it has some applications where it may be a better method than LNG, depending on the gas conditions and the distance from the end user. CNG can achieve ratios of roughly 300, or roughly a factor of two less than that of LNG but has advantages because the facilities required at both source and destination are simpler than those required for LNG.

Both LNG and CNG require some means to get the gas back to standard pipeline conditions once the gas has reached its desired destination. Both LNG and CNG have severe complications storing gas after delivery. For LNG this is addressed by building either pressurized or cryogenic storage containment tanks onshore. Both methods are expensive and dangerous. CNG has not been used to date, but one of the main reasons could be the lack of availability of efficient storage means.

Various oil storage systems have been deployed on the seafloor, namely the Harding platform in the North Sea and the Dubai Oil Storage tanks in the Middle East. Additionally, oil over water storage systems have been deployed from Gravity Based Structures in the North Sea. Whereas oil has been stored on the seafloor for many years and mainly as a matter of convenience, storage of gas on the seafloor has never been done and yet has some very important technical advantages over gas storage through other methods. Additionally, gas storage on the seafloor can be an enabling technology for some of the CNG applications that are currently contemplated.

All presently available means for storing natural gas are dangerous with significant potential for both environmental damage and loss of life and property. Underground natural salt caverns are typically used for low pressure storage of natural gas. There have been many accidents related to these caverns, including both fires and explosions. LNG storage tanks have also had major accidents resulting in disastrous consequences. As both LNG demand and population along the shores increase, it has become increasingly difficult too locate LNG regassification units for permitting reasons despite the large market need.

The proposed gas storage invention can serve in several applications.

A need exists for a system for storing natural gas which is produced during a well testing operation offshore wherein the oil and gas operator does not want to commit to building a pipeline for gas export before the reservoir has been producing for long enough to evaluate its characteristics and condition.

A need exists for a system that can store significant volumes of gas and yet can be readily deployed and reused at the end of its initial service. This system has to be both portable for second and additional use applications and the design must also be capable of addressing all anticipated applications including a range of water depths and pressures.

A need exists for a gas storage system that can be built in a desired location close to a pipeline network and independent of the prior existence of naturally occurring caverns.

A need exists for a gas storage system which is remote from human life and property.

A need exists for a gas storage system that is not prone to catastrophic gas release and consequent fire or explosion.

A need exists for a gas storage system that can be used in conjunction with any of the proposed CNG or LNG systems in order to decouple the depressurization conditions from the immediate pipeline needs.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

The invention relates to a gas storage vessel, such as a tank, with a water inlet exposed to local hydrostatic pressure which has the effect of compressing the gas to ambient hydrostatic conditions, thereby reducing the volume of the gas and increasing the amount of gas that can be stored in a very limited area.

Gas storage on the sea floor has not been practical for shallow water applications because the ambient pressures are not large enough to make the gas volume ratios favorable for use and implementation.

In contrast, deepwater conditions are nearly ideal for gas storage since the pressure factors approach those used in commercial compressed national gas (CNG) tankers and deepwater pipelines.

The invention enables gas storage in deepwater conditions where the discoveries are far from any existing infrastructure. In combination with a CNG carrier, the oil and gas operating company can therefore store the gas between various loading operations to the CNG carrier. Standard industry equipment can be used to compress the gas to desired pressures.

The present system is for use in water having a depth between 30 feet and 25,000 feet, preferably between 3000 feet and 12000 feet of water. The system has great versatility for use under water.

One embodiment involves an inflexible thin single walled vessel for storing compressed gas under water in deep water, wherein the storage vessel is pressure equalized by water surrounding the inflexible thin single walled vessel.

The present system contemplates a pressure equalized tank-based system which provides a constant design pressure for the tank regardless of the water depth of deployment. Through the pressure equalization mechanism, the tank external pressure varies linearly with the hydrostatic pressure associated with the water depth. The internal pressure is equal to the external pressure at the bottom of the tank and varies linearly up through the tank by the density of compressed gas, which is small in comparison to the linear variation of the external hydrostatic pressure. Although the hydrostatic pressure can vary substantially from one water depth to another, the tank is designed by the pressure difference between the hydrostatic head at the top of the tank and the internal pressure, which is equal to the hydrostatic head at the bottom of the tank. This pressure load is governed entirely by the height of the tank and is therefore entirely independent of the water depth.

The efficiency of this solution is driven mainly by the volume ratio, which varies with water depth. For ideal gases, the volume ratio is $$VolumeRatio = \frac{V_1}{V_2} = \frac{P_2 T_1}{P_1 T_2}$$

Figure 7:
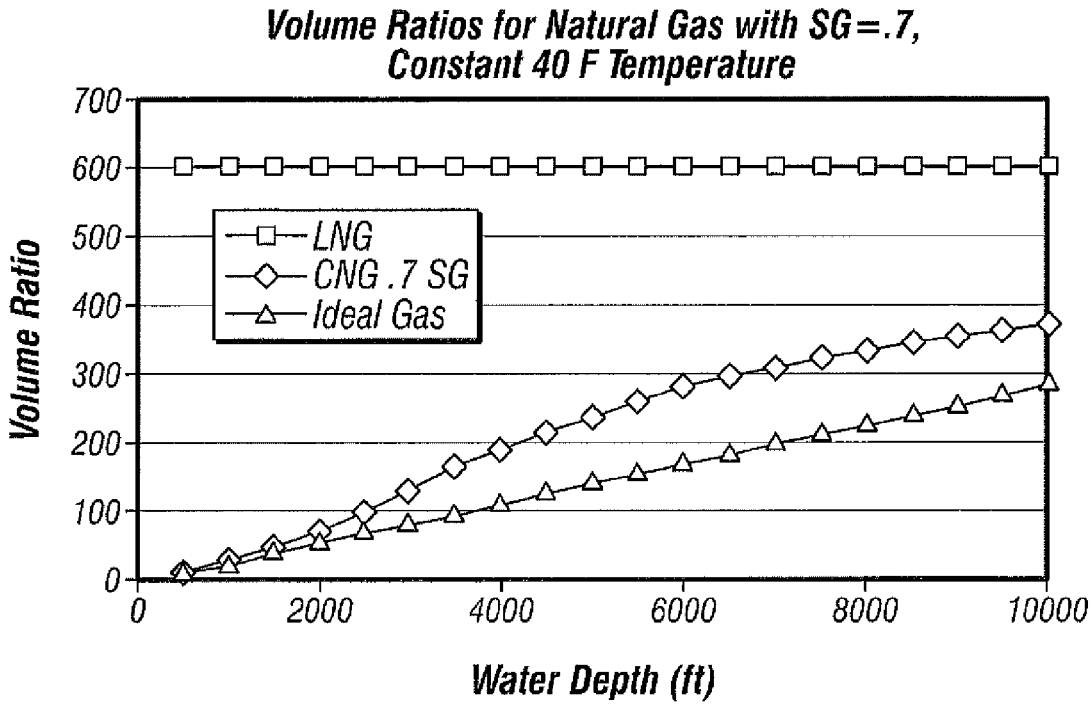
FIG. 7 is a chart of volume ratios for various water depths.

FIG. 7 shows the Volume Ratio associated with an ideal gas for deployment in various water depths and compared to LNG.

For gases that are associated with hydrocarbon exploration and production, the Volume Ratio is greater due to the "Compressibility Index". The Volume Ratio as modified by the Compressibility Index is $$VolumeRatio = \frac{V_1}{V_2} = \frac{P_2 T_1 Z_1}{P_1 T_2 Z_2}$$

FIG. 7 also shows the Volume Ratio associated with a typical natural gas with a Specific Gravity of 0.7. The natural temperature of the water at seafloor conditions varies throughout the world, but is typically in the range of 30 to 40 degrees F. which has a good although not optimal compressibility ratio. The ocean circulation and large water volume act as a thermal reservoir which naturally cools the gas in the tank.

Although the same tank can be deployed in any water depth due to the design, it can be seen that the Volume Ratio is 370 in 10,000 ft water and roughly 200 in 4,000 ft water and is therefore almost twice as efficient. Deployment of this system in 4,000 ft would therefore require twice as many tanks to accomplish the same amount of storage.

The individual tank capacity is contemplated to range from 50,000 cubic feet of storage to one million cubic feet of storage. If multiple tanks are used, then a tank farm formed of the individual tanks can be designed with a virtually unlimited capacity. The volume of gas storage at stp can be determined by multiplying the storage volume by the volume ratio.

The invention is used to load and unload ships, connect to pipelines, and to connect to portions of marine riser systems for offshore platforms and other floating vessels with riser connections.

Figure 1:
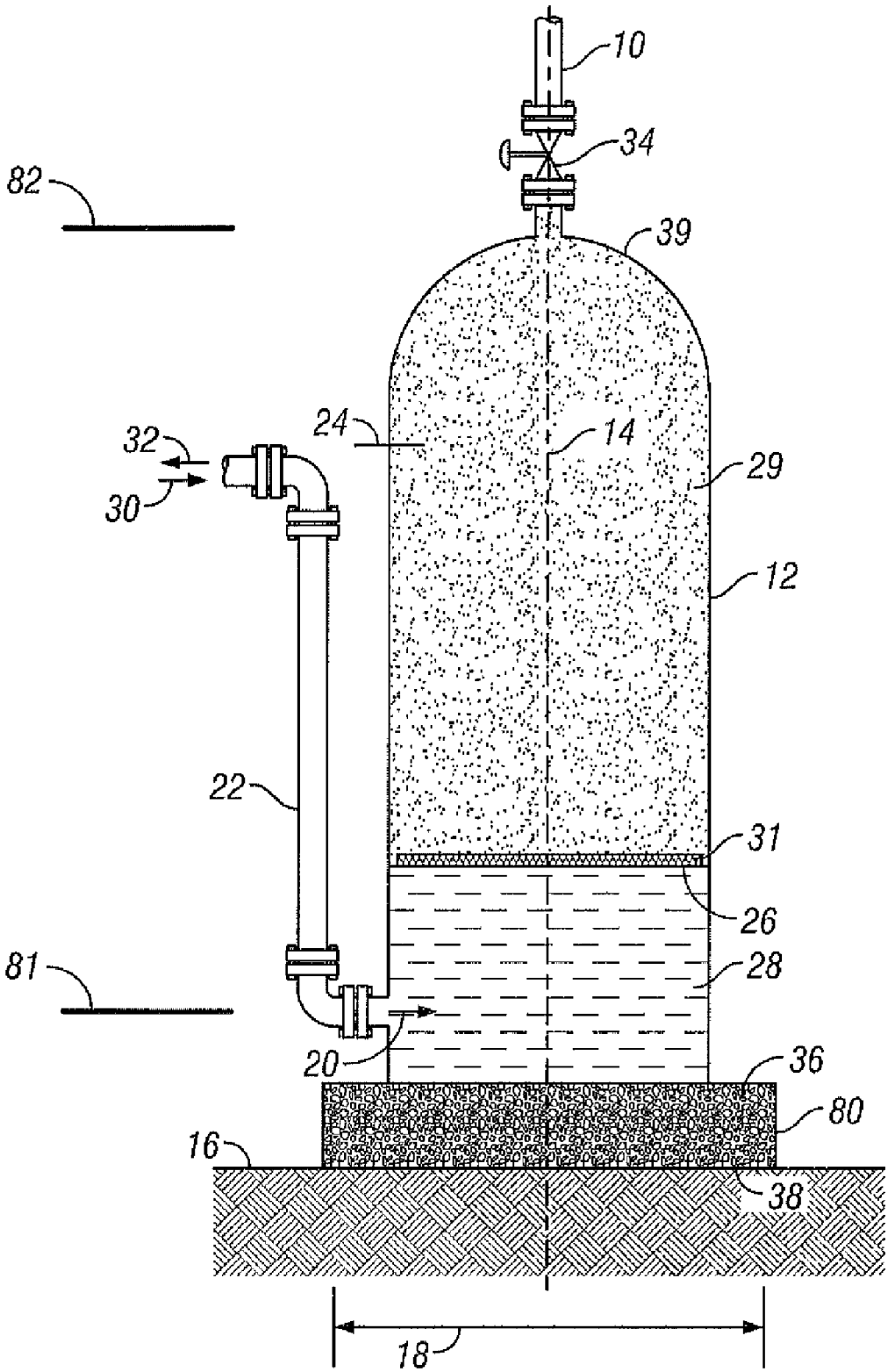
FIG. 1 depicts an overview of the vessel used with the gas storage system.

Turning to the Figures, as shown in FIG. 1, the deep ocean gas storage system connects to a compressed gas source via a gas intake 10 located in an upper portion of an inflexible thin single walled vessel 12, such as a tank. The inflexible thin single walled vessel can have an additional wall disposed adjacent to the inflexible thin single wall forming a two walled vessel. The compressed gas source can be located at the portion of the inflexible thin single walled vessel closest the water level, or at a side location near the top portion of the vessel. The gas intake 10 can be also the gas discharge line. A single line can be used for both intake and discharge, however two lines could be used.

The inflexible thin single walled vessel can be anchored to the water bed underneath the water. It can be contemplated that deep water is a water depth greater than 1000 feet.

The compressed gas can be compressed natural gas or any other gas including $CO_2$.

In addition, the vessel has a water port 20 which is located in a lower portion of the inflexible thin single walled vessel for admitting water to the inflexible thin single walled vessel and discharging water from the inflexible thin single walled vessel. The water port enables water to be admitted and discharged from the inflexible thin single walled vessel and the corresponding hydrostatic pressure of the adjacent water can be then used to discharge compressed gas from the inflexible thin single walled vessel at a pressure that varies only from the initial hydrostatic pressure at the bottom of the tank to the hydrostatic pressure at the top of the tank as the volume of the compressed gas in the storage vessel decreases and water content in the inflexible thin single walled vessel increases. The water port can admit and discharge water to the inflexible thin walled storage vessel enabling temperature and hydrostatic pressure of the water surrounding the storage vessel to store a quantity of compressed gas in the inflexible thin single walled vessel.

The water port engages a conduit 22 which can be oriented substantially parallel to the axis 14 of the inflexible thin single walled vessel and has a length enabling the discharge opening 24 of the conduit to be above the level of water in the vessel 12, which can be sea water, lake water, or fresh water if used at the bottom of a fresh water deep river system, like the Hudson River in New York. The level of water in the vessel is depicted as 26, with the water being element 28 and the compressed gas being shown as element 29. Water flow through the conduit is shown with arrows 30 and 32, with arrow 30 being the water admission into the conduit and arrow 32 representing the water discharge from the conduit. The conduit inlet can be a simple open bottom or water inlet pipe designed to maintain equilibrium with local hydrostatic conditions, compress gas and provide a natural pressure maintenance during loading operations.

Figure 8:
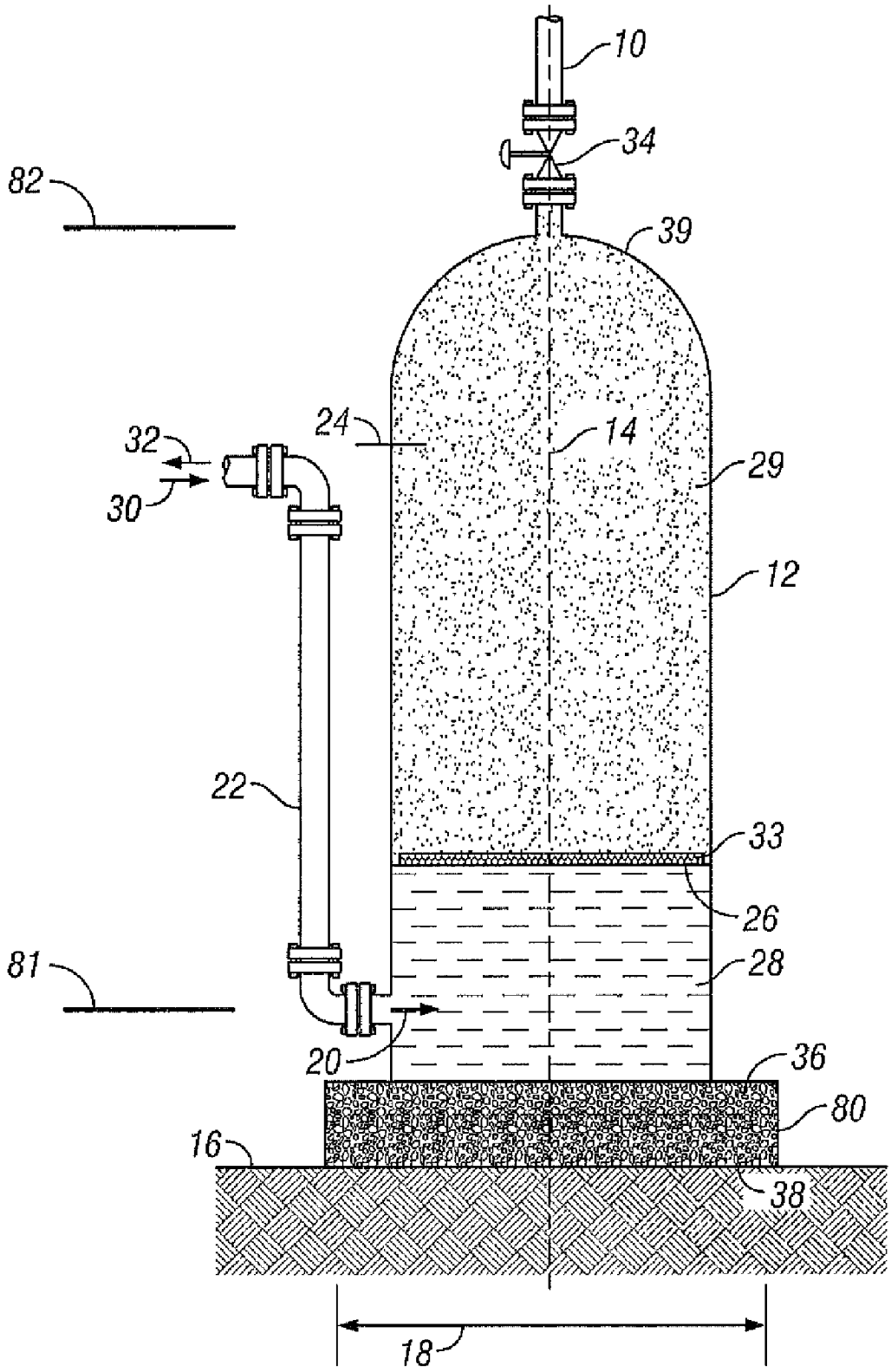
FIG. 8 depicts an alternative embodiment of the gas storage system including an inflatable, compressible bag.

Depending on the gas to be deployed, it may be necessary to provide a barrier between the water and the gas. A floating membrane 31 is shown as an example of a separating mechanism between the water 28 and the compressed gas to avoid the formation of hydrates or the diffusion of gas into the water. The floating membrane 31 can be of solid construction of any material that is less dense than water or of typical steel construction with additional buoyancy. The membrane is provided with a gasket assembly on its outside diameter to maintain separation between the water and the gas. In one embodiment of the deep ocean gas storage system, the floating membrane can be replaced by an inflatable, compressible bag for gas containment 33, as illustrated by FIG. 8.

In an alternative embodiment, the separation can be maintained by a flexible containment bag.

In an alternative embodiment, the membrane can be a layer of fluid, which provides an immiscible boundary such as would be provided by the oil-water emulsion layer at the interface.

The rate at which the water flows into or out of the tank is equal to the gas inflow and outflow and is equal to 200 to 2000 cubic feet of water per minute.

The inflexible thin walled storage vessel has an axis 14 which is substantially perpendicular to the sea floor 16 and forms a small footprint 18 on the sea floor which substantially reduces the environmental harm to the sea floor and habitat of the sea floor than would be the case with larger footprint storage vessels. It is contemplated that the small footprint can have a length of between 15 and 100 feet, and a width of between 15 and 100 feet. Other shapes for the tank can be contemplated other than circular, such as square and rectangular having similar dimensions to those listed above.

The inflexible thin walled storage vessel is a rigid thin walled storage vessel with stiff or stiffened walls made of steel, or a composite material. For a typical steel design, the wall thickness would be determined by the design pressure but would range from ½ inch to 1½ inches. The walls may include reinforcing ribs 24 to assist in strengthening the walls. The reinforcing ribs can be either inside the tank or outside, with a preference for outside due to its ease of construction and inspection. The top of the tank 39 can be formed of either a hemispherical or elliptical head typical of pressure vessel fabrication. It can alternately be stiffened panel construction with a flat top surface.

The inflexible thin walled storage vessel can receive compressed natural gas having a pressure from between about 150 psi and about 5000 psi. In an embodiment, the vessel can be tank about 40 feet in diameter and about 250 feet high. The tank can be a standard steel square or rectangular boxlike construction similar to that used by commercial shipyards or circular construction similar to tubular pressure vessel types. The tubular type is preferred because of the ease of construction, efficient structural design and large vertical forces being brought down to concentrated anchoring positions.

A valve 34, such as a typical 5000 psi electro-hydraulic subsea valve is located at the gas intake/gas discharge to the vessel and is used for controlling compressed gas admission and discharge. This valve can be simple shutoff valve or an actuated valve that shuts the valve down once the loading has finished. The valve stays closed until unloading of the gas initiates, when it is opened. The valve can be actuated remotely or as part of a local control system. The valve can be any of a number of commercially available valves for subsea usage.

The vessel is anchored to the sea floor using any number of techniques. FIG. 1 shows the use of solid ballast 36 that engages a mud mat 38.

The mud mat is a structure that is bottom founded and has a mat to distribute gravity forces over a large area. The mud mat and foundation of the vessel are equipped with structural members such as beams, that penetrate soil underwater and prevent lateral motion of the tank.

The solid ballast 36 can be deployed in a solid ballast containment structure 80 disposed on the mudmat for containment of solid ballast to counteract the upward vertical force of the net buoyancy of the contained gas. The solid ballast can be permanent, such as concrete if the application is considered to be permanent or it could be removable solid ballast, such as hematite or magnetite if the tank is to be movable. Any type of commonly used solid ballast can be used but a higher density type is preferred due to the large volume of material that will be necessary. Typical fixed ballast materials used for marine purposes will have specific gravities of about 3, compared to concrete with a specificity gravity of 2. The solid ballast is enough to equalize the buoyancy of the stored gas. It is anticipated that an additional volume of solid ballast will be provided as a safety factor. Additional ballast can be used to provide resistance to overturning moments caused by any seafloor currents that might exist.

Figure 3:
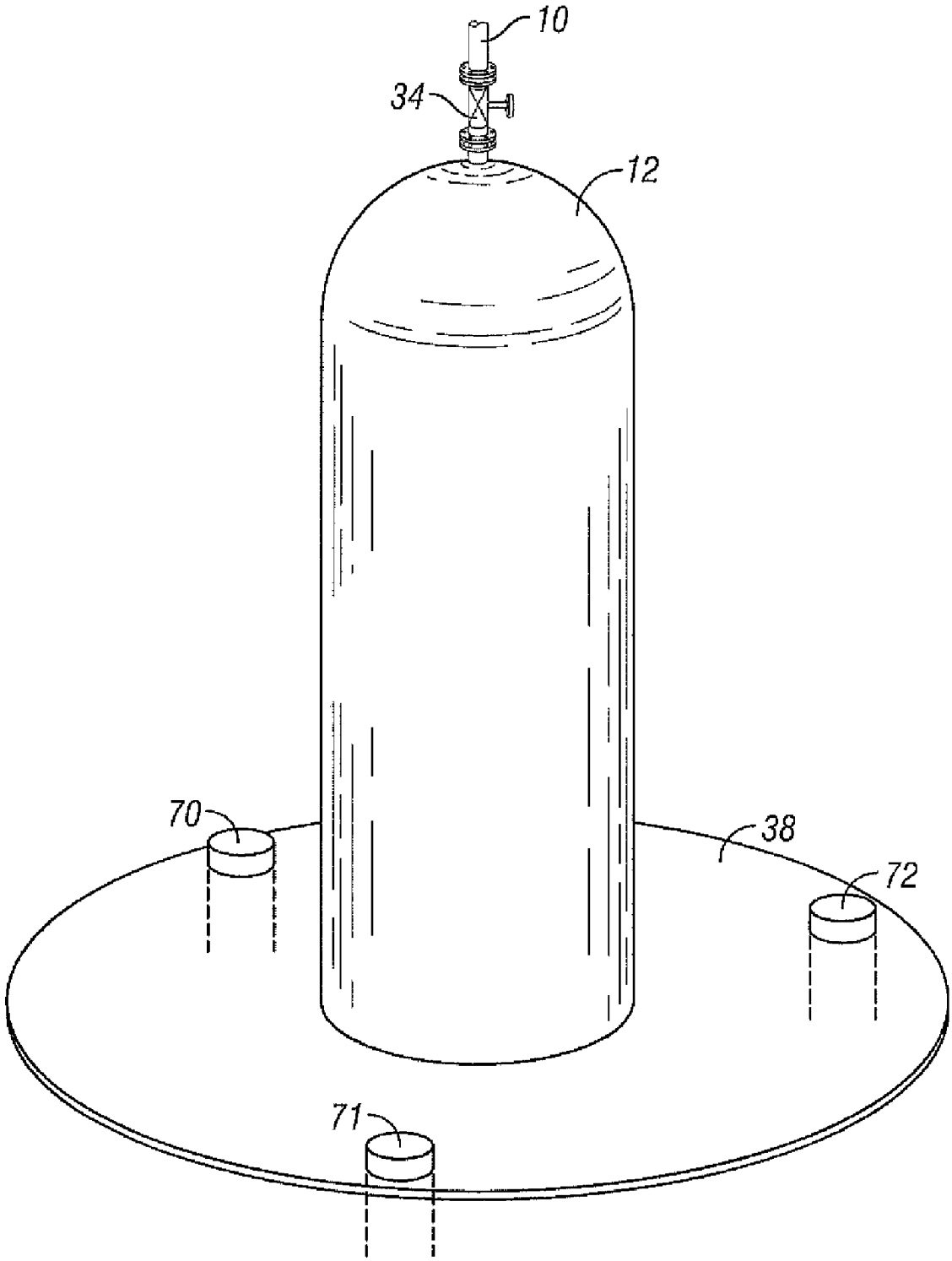
FIG. 3 is an embodiment of an anchoring system used to hold the vessel to the sea floor.

In another embodiment, the solid ballast can be replaced by the use of various types of vertically loaded anchors, such as suction piles, driven piles, drilled and grouted piles. FIG. 3 shows at least 3 anchors securing the vessel to the seafloor. The piles could be 50 feet to 200 feet long and have diameters ranging from 3 feet to 20 feet and wall thicknesses between 1 inches and 3 inches.

Figure 2:
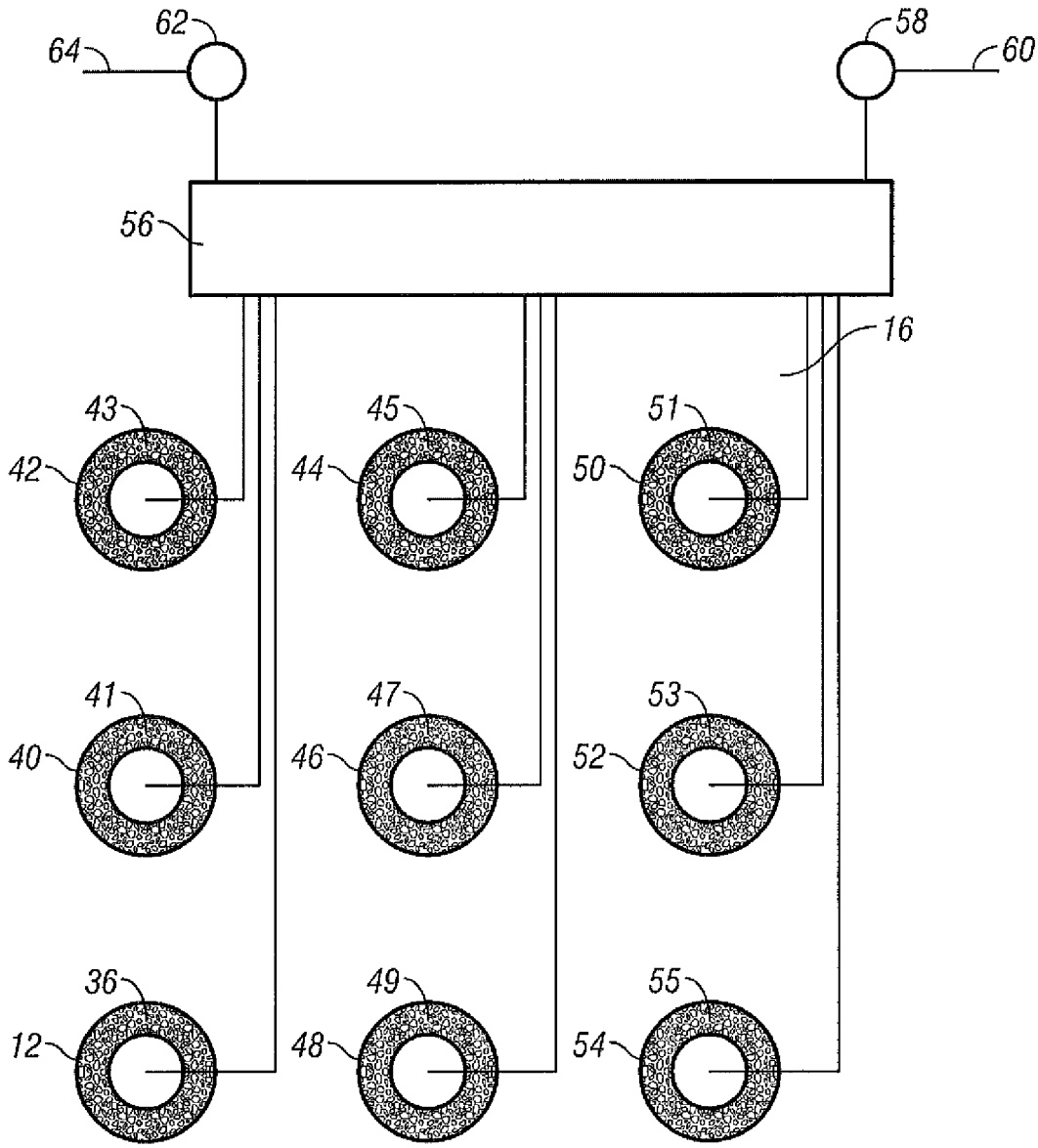
FIG. 2 is a view of a tank farm using a plurality of the vessels of FIG. 1.

FIG. 2 shows an embodiment of the invention wherein multiple vessels 12, 40, 43, 44, 46, 48, 50, 52, and 54 are connected to the sea floor. Vessel 12 has solid ballast 36, vessel 40 has solid ballast 41, vessel 42 has solid ballast 43, vessel 44 has solid ballast 45, vessel 46 has solid ballast 47, vessel 48 has solid ballast 49, vessel 50 has solid ballast 1, vessel 52 has solid ballast 53, vessel 54 has solid ballast 55.

Each of the vessels connects to a manifold 56 that engages a first riser base 58 for connecting to a supply line 60. Additionally the manifold 56 connects to a second riser base 62 that connects to an export line 64.

In one embodiment the supply line and the export line are a single line.

The manifold can be a Pipeline End Manifold (PLEM) which are commercially available from a range of suppliers including Vetco, FMC, and Cameron.

The supply line can be a compressed gas supply line such as an export riser from a production facility having a pressure of between 150 and 5000 psi. The export line can be an export riser to a tanker having a pressure between 150 and 5000 psi. The first and second riser bases can be typical subsea connections including a drilled and grouted pile and tieback connector. This type of connection is commercially available and manufactured by a range of suppliers including Vetco, FMC, and Cameron.

Due to standard construction techniques, the desired amount of gas storage may exceed what can be done using a single storage vessel. A plurality of the vessels located in close proximity to each other can be connected to the manifold assembly. For the tank farm, each vessel has a valve, there is a control termination box for connection of each umbilical, a valve for each export connection and a foundation for gravity support.

The vessel can be used for well testing and extended well testing. In the planning stages of a deepwater project, it is desirable to produce the discovery wells for a period of time to begin to understand the reservoir conditions. Preferably the testing would last a year or two as the reservoir parameters are being investigated for better understanding. During this time, it is possible to get oil to market, generating cash flow by use of a floating storage and offload (FSO) facility, but the gas disposal is problematic, and can be solved with this system. This system obviates the need for flaring and re-injection so that gas can be sold generating additional cash flow while reservoir testing occurs.

Figure 4:
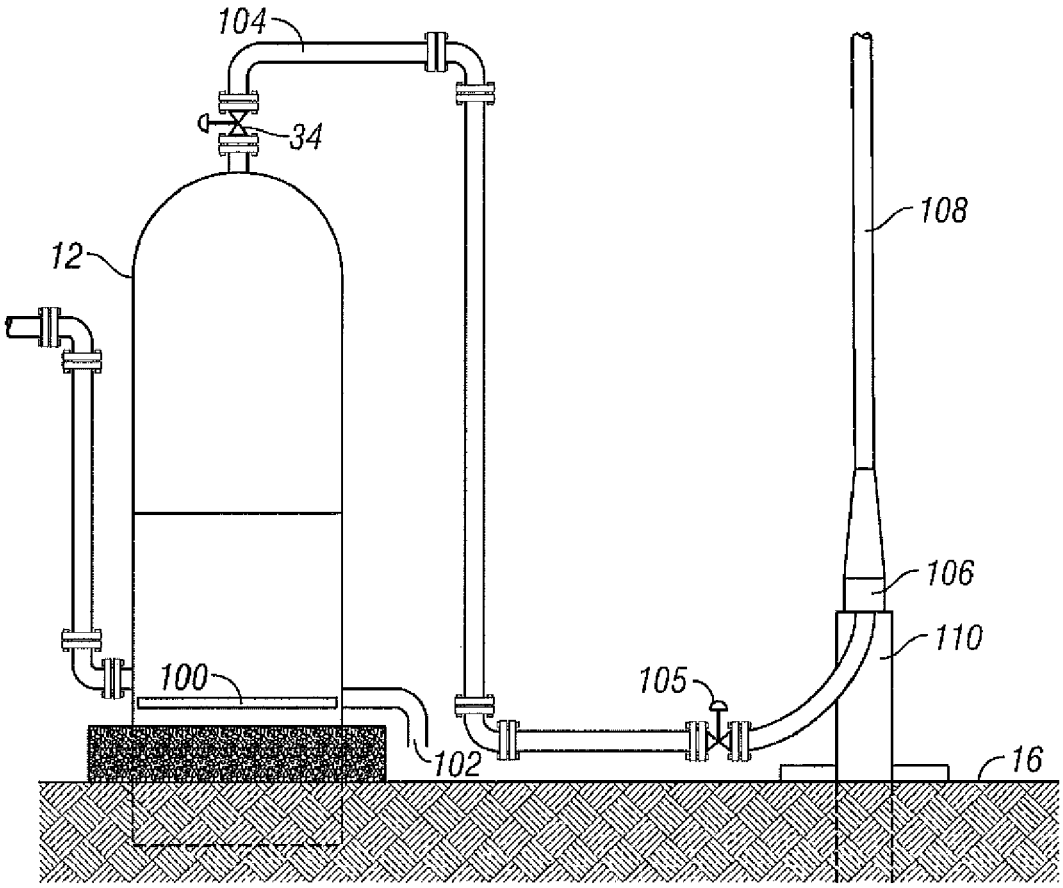
FIG. 4 is side view of the system demonstrating the interfaces with marine risers.

As shown in FIG. 4, the vessel can further act as a separator 100 disposed in the base of the vessel 12 for collecting particulates and other liquids from the compressed gas enabling the discharge of cleaned gas. The vessel further includes a discharge port 102 disposed in the vessel to remove particulates collected in the separator.

FIG. 4 shows that the system can be connected through a tie-in to a marine riser for offloading of the compressed gas from the tank to a ship or to another storage vessel. More specifically, FIG. 4 shows that a gas conduit 104 which transmits the gas to the surface connected to a stress joint connected to a tie-back connector 106 to securely fasten the marine riser 108 to the riser base 110, which is embedded in the seafloor 16. A shut-off valve 105 is disposed in the gas conduit 104 for controlling the offloading of compressed gas to the ship, or other storage vessel.

A shut off valve 34 is disposed in the gas conduit for starting or stopping the compressed gas offloading to the ship or other storage facility.

The invention has to interface with a number of components as shown in FIG. 3, the supply line, and export line and a control umbilical for actuation of the subsea control valves, which is not shown. The supply and export lines could be configured as typical marine risers that have components such as a steel rigid vertical riser, a stress joint configured to minimize stresses when surface loading facility is offset from a design location, a tie back connector and a riser base.

Figure 5:
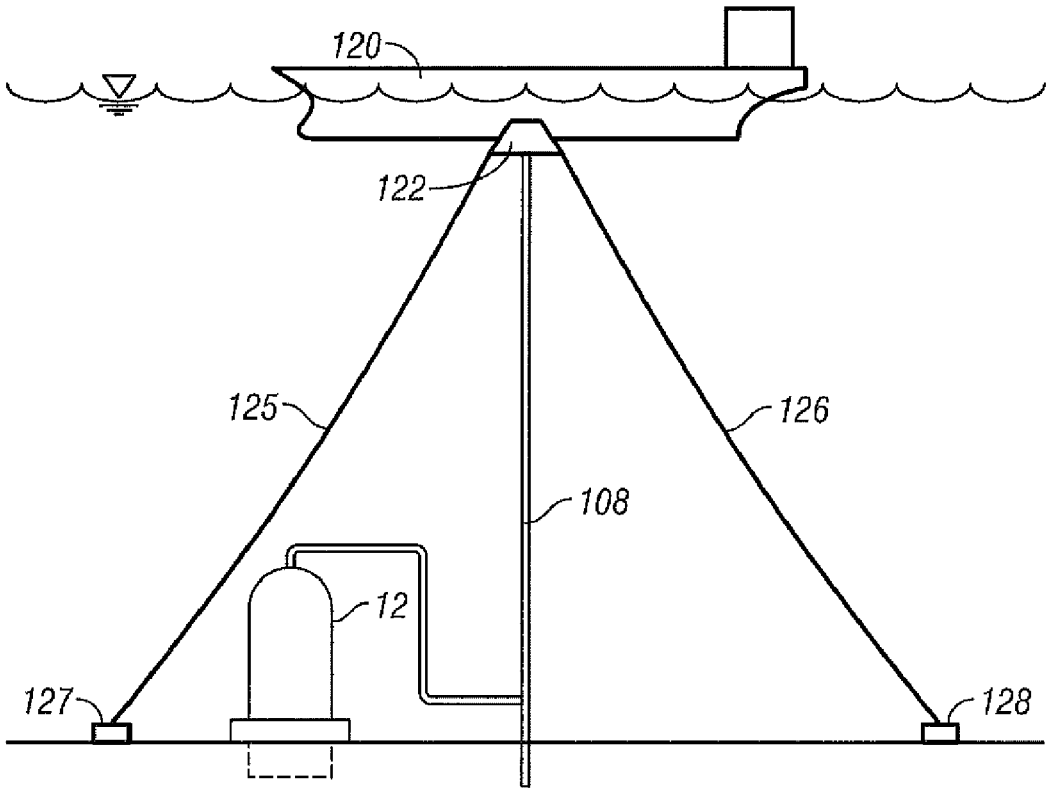
FIG. 5 is a side view of a CNG tanker unloading the storage tanks

The tank system can export directly to a CNG ship 120 as shown in FIG. 5, which can be connected to an offloading buoy 122 which is moored in place by mooring lines 125 and 126 that are connected to anchors at the seafloor 127 and 128. The offloading buoy, and all mooring line components are readily available on the market from a variety of suppliers. The CNG ship transports the compressed gas to a market, where it can be sold.

Figure 6:
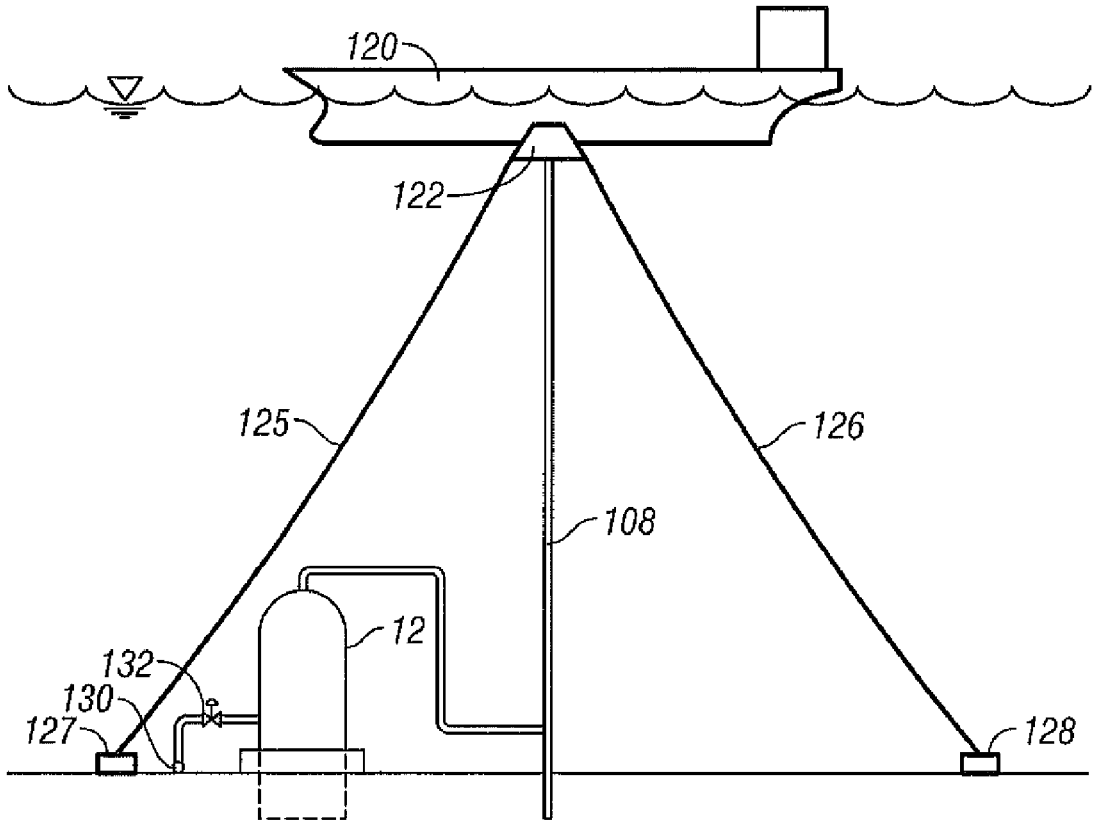
FIG. 6 is a side view of a CNG tanker loading the storage tanks which are connected to the pipeline.

The invention can also be used as a storage facility for use in offloading CNG terminals prior to injection into the pipeline system as shown in FIG. 6. In this application, a storage facility tank farm has an inlet from a buoy for connection to a CNG tanker and a seafloor connection to a pipeline system. The gas is then discharged directly into the tank farm under water for storage. The storage system is connected to the pipeline 130 using a pressure regulating controlled valve 132 to ensure that the gas is added to the pipeline at the correct pressure. The storage tanks can thus be located near major markets for delivery while avoiding larges surges in pipeline pressures and thermal effects during offloading, which is otherwise common in CNG.

The system also includes a control/monitoring system, similar to the ones currently used in the art, for monitoring the gas in the vessel and for controlling the flow of the gas to and from the vessel. The gas level can be measured by any conventional means, including float, inductance, resistivity, or capacitance gauges. Using electrical rather than mechanical level gauging is preferred because the instruments could then be deployed on the outside of the tank rather than the inside and can therefore be maintained more easily. Control functions for closing the valve must be provided to make sure that the gas level does not go lower than the low level 81 and does not go higher than the high level 82.

Valves are provided at both the local tank level and at the manifold inlet and outlet so that one tank can be shut down individually while allowing the rest of the tanks and the manifold to continue supply or discharge operations.

While these embodiments have been described with emphasis on the embodiments, it should be understood that within the scope of the appended claims, the embodiments might be practiced other than as specifically described herein.

What is claimed is:

1. A deep water gas storage system for storing a compressed gas, the system comprising:

an inflexible thin walled vessel positioned under deep water and having a first end at a first water depth and a second end at a second water depth less than the first water depth, the vessel adapted to store the compressed gas such that:

a pressure of the compressed gas proximate the first end is substantially equal to a hydrostatic pressure of the water at the first water depth;

a pressure of the compressed gas proximate the second end is less than a hydrostatic pressure of the water at the second water depth; and a pressure of the compressed gas between the first end and the second end and at a third water depth, wherein the third water depth is between the first water depth and the second water depth, is a linear function of a density of the compressed gas and independent of a hydrostatic pressure of the water at the third water depth;

wherein the compressed gas within the vessel has a compression ratio of at least 5;

a compressed gas intake coupled to the vessel for admitting and discharging the compressed gas to and from the vessel;

a water port in the vessel, the water port positioned at a water depth greater than that of the compressed gas intake and adapted to freely admit water to and discharge water from the vessel;

a valve coupled between the compressed gas intake and the vessel, the valve operable to control compressed gas admission to and discharge from the vessel; and a tie-in to a marine riser for offloading of the compressed gas to a ship, wherein the tie-in to the marine riser comprises:

a gas conduit for engaging a tie-back connector in the marine riser connected to a riser base in the sea floor; and a shut off valve disposed in the gas conduit for starting or stopping the compressed gas offloading to the ship.

2. The system of claim 1, wherein the vessel has at least an additional wall disposed adjacent the inflexible thin wall forming at least a two wall vessel.

3. The system of claim 1, wherein the vessel is anchored to the water bed under water.

4. The system of claim 1 wherein deep water is a water depth greater than 1000 feet.

5. The system of claim 1, wherein the compressed gas is compressed gas from a well or a gas that has been compressed using a compressor.

6. The system of claim 1, further comprising a floating membrane disposed within the vessel, the membrane separating the compressed gas and the water.

7. The system of claim 6, wherein the floating membrane is an immiscible fluid.

8. The system of claim 1, wherein the vessel is anchored to the sea floor by a solid ballast.

9. The system of claim 1, wherein the vessel is relocatable from a first water bed location to a second water bed location.

10. The system of claim 1, wherein a plurality of vessels are anchored to the water bed and connected to a manifold that engages to a supply line and an export line.

11. The system of claim 10, wherein the supply line and the export line are a single line.

12. The system of claim 1, wherein the vessel is adaptable for well testing.

13. The system of claim 1, wherein the valve is an electro hydraulic valve.

14. The system of claim 1, further comprising a control/monitoring system for monitoring the compressed gas in the vessel and for controlling the flow of the gas to and from the vessel.

15. The system of claim 1, further comprising a conduit fluidly connected with the water port, wherein the conduit is oriented parallel to the axis for emitting and discharging water.

16. The system of claim 1, further comprising a connection to a pipeline for injection into a gas pipeline transmission system.

17. A deep water gas storage system for storing a compressed gas, the system comprising:

an inflexible thin walled vessel positioned under deep water and having a first end at a first water depth, the vessel adapted to store the compressed gas such that:

a pressure of the compressed gas proximate the first end is substantially equal to a hydrostatic pressure of the water at the first water depth; and a pressure of the compressed gas proximate a second water, wherein the second water depth is less than the first water depth, is a linear function of a density of the compressed gas and independent of a hydrostatic pressure of the water at the second water depth;

wherein the compressed gas within the vessel has a compression ratio of at least 5;

a compressed gas intake coupled to the vessel for admitting and discharging the compressed gas to and from the vessel;

a water port in the vessel, the water port positioned at a water depth greater than that of the compressed gas intake and enabling free flow of water into and out of the vessel;

a valve coupled between the compressed gas intake and the vessel, the valve operable to control compressed gas admission to and discharge from the vessel; and an inflatable, compressible bag for gas containment disposed within the vessel, the bag floating on water and providing a separation between the compressed gas and the water.

18. A deep water gas storage system for storing a compressed gas, the system comprising:

an inflexible thin walled vessel positioned under deep water and having a first end at a first water depth and a second end at a second water depth less than the first water depth, the vessel adapted to store the compressed gas such that:

a pressure of the compressed gas proximate the first end is substantially equal to a hydrostatic pressure of the water at the first water depth;

a pressure of the compressed gas proximate the second end is less than a hydrostatic pressure of the water at the second water depth; and a pressure of the compressed gas between the first end and the second end and at a third water depth, wherein the third water depth is between the first water depth and the second water depth, is a linear function of a density of the compressed gas and independent of a hydrostatic pressure of the water at the third water depth;

a compressed gas intake coupled to the vessel for admitting and discharging the compressed gas to and from the vessel;

a water port in the vessel, the water port positioned at a water depth greater than that of the compressed gas intake and adapted to freely admit water to and discharge water from the vessel.

* * * * *